United States Patent [19]

McPherren

[11] 4,144,830

[45] Mar. 20, 1979

[54] LOW FRICTION TRACK TRAVELER

[75] Inventor: Glen E. McPherren, San Diego, Calif.

[73] Assignee: Nicro Corporation, San Leandro, Calif.

[21] Appl. No.: 852,661

[22] Filed: Nov. 18, 1977

[51] Int. Cl.[2] ..... B63B 21/24; B63B 21/27; B63B 21/29

[52] U.S. Cl. ..... 114/204; 105/141; 308/6 C

[58] Field of Search ..... 114/112, 204, 218; 104/118, 119, 120, 89, 93; 308/6 C; 105/141, 145, 148, 150

[56] References Cited

U.S. PATENT DOCUMENTS

| | | | |
|---|---|---|---|
| 3,168,875 | 2/1965 | Reed | 104/120 |
| 3,318,109 | 5/1967 | Ressler | 308/6 C |
| 3,326,170 | 6/1967 | Lewery | 114/204 |
| 3,352,273 | 11/1967 | Herreshoff | 114/218 |
| 3,985,092 | 10/1976 | Robbins | 114/204 |

FOREIGN PATENT DOCUMENTS

| | | | |
|---|---|---|---|
| 979339 | 1/1965 | United Kingdom | 114/204 |

*Primary Examiner*—Trygve M. Blix
*Assistant Examiner*—D. W. Keen
*Attorney, Agent, or Firm*—Owen, Wickersham & Erickson

[57] ABSTRACT

A traveler assembly adapted to hold a line under tension while being movable on a track as on a sailing craft. The assembly comprises a main car section having parallel, spaced apart side portions and a connecting portion with apparatus to retain the line under tension. Fixed to the inner surface of each side portion is a generally oval shaped race filled with ball bearings specifically sized and positioned to be located close to but having some clearance with the surfaces of the track. At any lead angle of tension force applied to the main car section at least some of the ball bearings of either one or both races will contact and transmit the main tension forces to the track so that the traveler assembly can move along the track with a minimum of friction.

6 Claims, 5 Drawing Figures

LOW FRICTION TRACK TRAVELER

This invention relates to an improved traveler particularly adapted for use on sailing craft.

BACKGROUND OF THE INVENTION

Such so-called travelers or sliders are mounted on a section of track fixed at a preselected location, so that it will retain one end of a line and maintain tension on it and yet be freely movable along the track. For example, the line to the traveler may be attached to the main sheet boom of a sailing craft and be under considerable tension and yet movable along the track as the main boom changes its position. The required movement and varying loads applied from different angles to the traveler heretofore created a severe friction problem which restricted its reaction time. Prior attempts to solve this problem included the use of rollers and tracks of various cross-sectional configurations. For example, the U.S. Pat. No. 3,326,170 shows the use of an X-shaped track in conjunction with a traveler having side rollers mounted at angles in order to ride along the sloped surfaces of the track. In addition to the side rollers, top rollers mounted on vertical spindles were also required in order to reduce friction under different loading conditions. Despite its relative complexity, the aforesaid as well as other prior art travelers failed to eliminate completely the problem of excessive friction at all angles of line tension on the traveler.

A general object of the present invention is to solve this friction problem in a traveler that is adaptable for use in a wide variety of installations.

A further object of the present invention is to provide a traveler that is particularly well adapted for ease and economy of manufacture.

Another object of the invention is to provide a traveler car adapted for use on an I-shaped track and utilizing two races filled with circulating ball bearings arranged so that under any load from any angle applied to the car, only ball bearings are in contact with the track.

BRIEF SUMMARY OF THE INVENTION

A traveler embodying the principles of the present invention is adapted for use on an "I" shaped track having upper and lower horizontal flanges interconnected by a vertical web. Generally, the traveler comprises a main car section which is fabricated as two identical half-sections that are secured together by suitable connecting bolts or fasteners. Fixed to the inside surface of each half-section (directly adjacent to the adjacent rack web section) is a continuous, oval-shaped race member filled with ball bearings. The depth of the race groove is such that the ball bearings project outwardly and extend closely adjacent to the upper and lower flanges of the track. On the upper, exterior side of the traveler car section is a retaining pin for conveniently retaining the loop of ring fitting of a line attached to a main sheet boom or some other movable structure. Even though the tension force of the line may be applied or from varied and changing angles on the traveler, at least some of the ball bearings are in constant rolling contact with the flanges of the track, so that movement of the car is provided with minimum friction.

Other objects, advantages and features of the present invention will become apparent from the following description of one embodiment thereof, presented in conjunction with the accompanying drawing.

DETAILED DESCRIPTION OF EMBODIMENT

Figure 2:
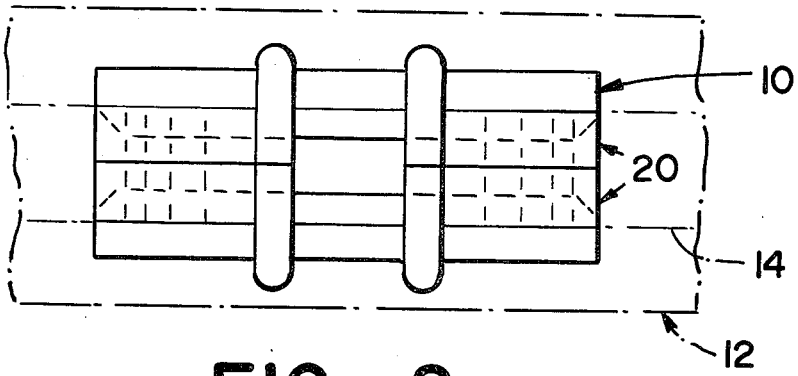
FIG. 2 is a top view of the traveler of FIG. 1.
Figure 1:
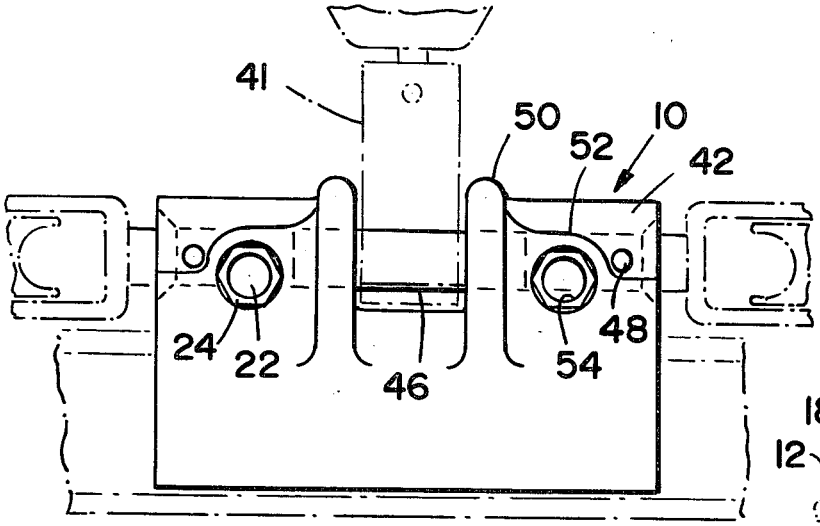
FIG. 1 is a view in side elevation of a traveler according to the present invention.
Figure 3:
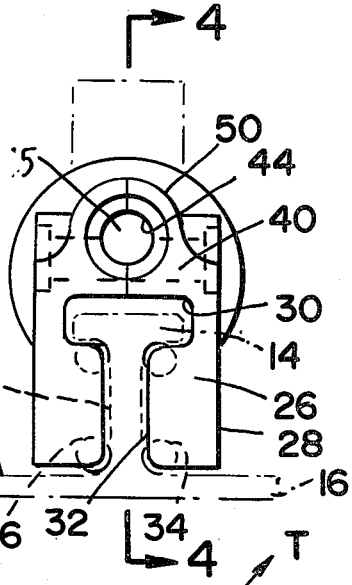
FIG. 3 is an end view in elevation of the traveler of FIG. 1.

With reference to the drawing, FIGS. 1–3 illustrate a traveler 10 according to the present invention that is adapted to retain the end of a line under tension while being movable along a track 12 with a minimum of frictional resistance. The track used with the traveler, as shown in phantom lines in the drawing, has generally an "I" shaped cross section comprised of top and bottom horizontal flanges 14 and 16 and an interconnecting vertical web portion 18.

Figure 4:
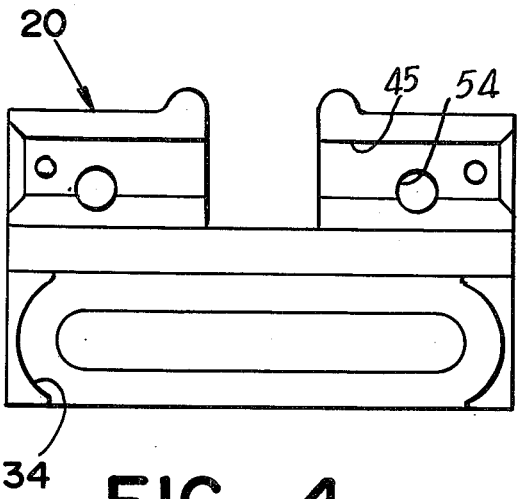
FIG. 4 is a view in section taken along line 4—4 of FIG. 3 and showing one half section of the traveler car.

The traveler 12 is comprised of two identical half car sections 20 which are held together by a pair of transverse machine bolts 22 and mating nuts or fasteners 24. Each car section is preferably cast from a suitable material such as stainless steel and then machined to its proper configuration and dimensions. As shown in FIG. 3, a lower portion 26 of each car section has a flat, outside surface 28 on one side and is formed with a horizontal slot 30 on its inside which extends from end to end. This slot provides clearance for the top flange 14 of the track. Below the slot 30, the lower portion 26 of each car section is thicker and has an inner surface 32 whose height is somewhat less than the distance between the track flanges. Within this inner surface of the thicker lower car section is an elongated, generally oval-shaped race or groove 34 with semi-circular end portions connected by straight upper and lower horizontal portions, as shown in FIG. 4. This groove in each car section has a generally semi-cylindrical cross-section to accommodate a series of ball bearings 36, all of which have the same radius as the radius of the race or groove 34. The center line of the straight groove portions is spaced downwardly and upwardly from the horizontal top and bottom edges of the thickened lower portion 26 of each car section. Thus, the ball bearings, when in these portions of the groove 34, project well outwardly from the inner surface of the thicker lower car section.

Along the slot 30 of each car section, the thickness of material is relatively narrow in cross-section, and above the slot a larger upper portion 40 is provided for retaining the end of a line 41 to be held by the traveler 10. Thus, the upper portion in the form shown comprises a pair of axially spaced apart projections 42 having generally a half-sleeve like configuration. Each projection has an axially extending semi-cylindrical recess 44 and these recesses for two mating half car sections, form an axial bore 45 for a cylindrical retaining pin 46 which fits therein with a sliding clearance. This pin has a length that allows it to fit just inside the two transverse bolts 22 which thereby also serve to retain the pin from axial movement. When the two half car sections are joined together, the inner ends of the sleeve-like projections 42 preferably terminate at enlarged, spaced apart outwardly curved end portions 50, having a greater diameter than the sleeve portion 42. These enlarged end portions provide added rigidity and strength to the car at this point. Adjacent to each curved end portion is an outwardly projecting boss member 52 surrounding a transverse bore 54. When a pair of half car sections are placed together, the bores 54 are aligned to accommodate the transverse machine bolts 22 that hold the car sections together.

In a typical installation of the traveler 10, according to the invention, the two half car sections 20 are held firmly together on opposite sides of a track by the transverse bolts 22 and their fasteners 24. A ring type fitting or the loop end of a line 41 is inserted between the upper projections 42 of the car so that the retaining pin 46 can be passed through it and be held in place by the transverse bolts.

As shown in phantom, a pin-type fitting may be inserted within each end of the axial bore 45 so that it can be retained therein by a transverse locking pin through aligned holes 48 in the sleeve-like upper car portions 42. In a typical arrangement, the pin-type fitting would be fixed to a block for a line from a rail.

Figure 5:
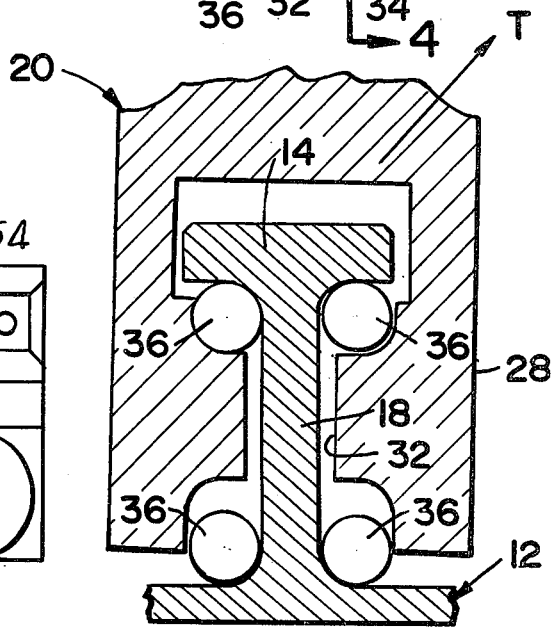
FIG. 5 is a diagrammatic view in cross section showing a traveler according to the present invention when subjected to skewed loading.

The ball bearings 36 for the lower car sections are installed and fill both oval races 34 before the two car sections are connected. When installed, the main load applied to the traveler retaining pin 46 is always transmitted through some of the ball bearings to the track. When the traveler is merely sitting on the track under only a gravity load, the balls 36 in the bottom straight portions of the groove 34 are in contact with the inside surfaces of the lower horizontal flange 16 of the track. At this point, the balls and their tracks are dimensioned so that there is some clearance between the balls in the top straight portions of the track. Now, if a skewed tension load (such as designated by the arrow T) is applied by a line 41 to the traveler on a track, as indicated diagrammatically in FIG. 5, the entire traveler car 10 will tip slightly and the top balls on one side of the car and the bottom balls on the other side thereof will contact the adjacent track surfaces. Although there must always be some small amount of clearance or play between the traveler and its track, no load can be applied to the traveler that is not transmitted via at least some of the ball bearings to the track surfaces. Thus, since the ball bearings are free to rotate in their respective races, the traveler 10 can be subjected to unusually high side loads and yet move freely along the track.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

I claim:

1. A traveler car adapted for movement along a track having an I-beam-shaped cross-section with a central vertical web and integral upper and lower horizontal flanges, said traveler comprising:

a main body section with retainer means for holding the end of a line in tension;

a pair of spaced apart lower body portions attached to and extending downwardly from said main body section so as to be positioned on opposite sides of said track;

means forming a continuous race on the inside surface of each said lower body portion, said two races being in generally parallel, vertical planes on either side of said central vertical web and each including a straight upper reach and a straight lower reach;

a plurality of recirculating balls filling each said race, said balls of each race being exposed to the track along both the upper and lower reaches;

whereby for every direction of tension force applied to said retainer means at least some of said recirculating balls of said lower body portions are constantly in contact with surfaces on said track.

2. The traveler car of claim 1, comprising two halves divided along a longitudinal vertical plane, each half of the main body section being integral with one of said downwardly extending lower body portions, and transverse fastener members securing the two halves together about the track.

3. The traveler car of claim 2 wherein said retainer means for holding the end of a line in tension comprises a longitudinal bore formed near the top of the main body section by aligned recesses in each half of the traveler car, said bore being interrupted by a central open area, and a pin retained in the longitudinal bore when the halves are assembled, so that the end of the line may be secured around the pin in the central open area.

4. A traveler car adapted for movement along a track having an I-shaped cross-section with a central vertical web and integral upper and lower horizontal flanges, said traveler comprising:

a main body section with retainer means for holding the end of a line in tension, said main body section being formed as a pair of halves and including, boss portions spaced apart longitudinally on said main body portion on each of said halves, and transverse fastener members in each boss portion for securing said halves together;

a pair of spaced apart lower body portions, each attached to and extending downwardly from one of said main body section halves so as to be positioned on opposite sides of said track;

means forming a continuous race on the inside surface of each said lower body portion;

a plurality of recirculating balls filling each said race, said balls extending outwardly toward the track, from the adjacent surface of each said lower body portion; and each said main body section half having a longitudinal groove on one side, said grooves forming a cylindrical bore when said halves are held together by said transverse fastener members, with a cylindrical pin in said bore forming said retainer means said cylindrical bore having a hole near each end through which said transverse fastener members extend when the traveler car is assembled;

whereby for every direction of tension force applied to said retainer means at least some of said recirculating balls of said lower body portions are constantly in contact with surfaces on said track.

5. A traveler assembly, comprising:

a beam type track capable of withstanding substantial vertical and horizontal transverse loading, being of generally I-beam-shaped cross-section with a central web and integral opposed flanges; and a traveler adapted for movement along the track comprising a main body section with retainer means for holding the end of a line in tension, a pair of spaced apart body portions connected to said main body section and positioned on opposite sides of the web of the track, means in each body portion forming a continuous generally oval-shaped race adjacent to the web, each race having two spaced parallel linear portions, one near each opposed flange of the track where it extends from the web, said two races being in parallel planes on either side of the web, with a plurality of recirculating balls filling each race, so that in each race, balls are exposed to the track along each of the two spaced parallel linear portions;

whereby balls of at least two of the four linear race portions are always in bearing contact with the track, regardless of the direction of tensioning force in the line.

6. The traveler assembly of claim 5 wherein the track, at each location where a flange extends from the web, is formed in a radius approximately the same as that of the balls, with a corresponding opposed radius on the adjacent race of the traveler.

* * * * *